US005609084A

United States Patent [19]

Gronbjerg

[11] Patent Number: 5,609,084

[45] Date of Patent: Mar. 11, 1997

[54] MACHINE FOR CUTTING A PAPER WEB INTO SHEETS WITH SIMULTANEOUS CUTTING OF A TRANSVERSE STRIP

[76] Inventor: Ib Gronbjerg, Vingetoften 24, 2730 Herlev, Denmark

[21] Appl. No.: 338,474

[22] PCT Filed: May 17, 1993

[86] PCT No.: PCT/DK93/00166

§ 371 Date: Dec. 16, 1994

§ 102(e) Date: Dec. 16, 1994

[87] PCT Pub. No.: WO93/23215

PCT Pub. Date: Nov. 25, 1993

[30] Foreign Application Priority Data

May 18, 1992 [DK] Denmark ..... 0649/92

[51] Int. Cl.[6] ..... B26D 7/18; B26D 7/26

[52] U.S. Cl. ..... 83/100; 83/98; 83/152; 83/343; 83/349

[58] Field of Search ..... 83/349, 331, 332, 83/343, 345, 346, 100, 152, 98, 169, 824

[56] References Cited

U.S. PATENT DOCUMENTS

| | | | |
|---|---|---|---|
| 3,166,965 | 1/1965 | Stemmler | 83/349 |
| 3,709,077 | 1/1973 | Trogan et al. | 83/345 |
| 3,835,754 | 9/1974 | Lewyckyj | 83/349 |
| 3,899,947 | 8/1975 | Faltin | 83/349 |
| 4,080,856 | 3/1978 | Shearon | 83/100 |
| 4,452,114 | 6/1984 | Rynik et al. | 83/98 |
| 4,467,687 | 8/1984 | Fokos et al. . | |
| 4,524,658 | 6/1985 | Focke et al. | 83/349 |
| 4,537,588 | 8/1985 | Ehlscheid et al. | 83/349 |
| 4,561,928 | 12/1985 | Malthouse | 83/349 |
| 4,993,293 | 2/1991 | Christoffersson et al. | 83/98 |
| 5,109,741 | 5/1992 | Fuchs | 83/346 |
| 5,140,880 | 8/1992 | Littleton . | |

FOREIGN PATENT DOCUMENTS

| | | |
|---|---|---|
| 468254 | 7/1991 | European Pat. Off. . |
| 1285675 | 8/1972 | United Kingdom . |

*Primary Examiner*—Eugenia Jones
*Assistant Examiner*—Charles Goodman
*Attorney, Agent, or Firm*—Jacobson, Price, Holman & Stern, PLLC

[57] ABSTRACT

A machine simultaneously cuts a paper web into sheets and adjacent strips. A substantially stationary knife having a blade extending substantially transverse to the direction of movement of the web cooperates with knives on a knife-supporting cylinder. The cylinder is mounted for powered rotation about an axis, and has a substantially circular peripheral surface and at least one chord face formed in the peripheral surface. First and second movable blades are mounted to the chord face. The cylinder is solid and the movable knives enhance the bending resistance of the cylinder. The knife edges of the movable knives are circumferentially spaced from each other in the direction of rotation of the cylinder about its axis. A particular channel is provided connecting a cut web-strip-retaining groove between the movable knives to a source of vacuum, or compressed or ambient air, the cut web strip-retaining groove connected to the source of vacuum when the groove is adjacent the stationary knife, and to the source of compressed or ambient air when remote from the stationary knife (e.g. in alignment with a suction funnel).

13 Claims, 4 Drawing Sheets

Figure 1:
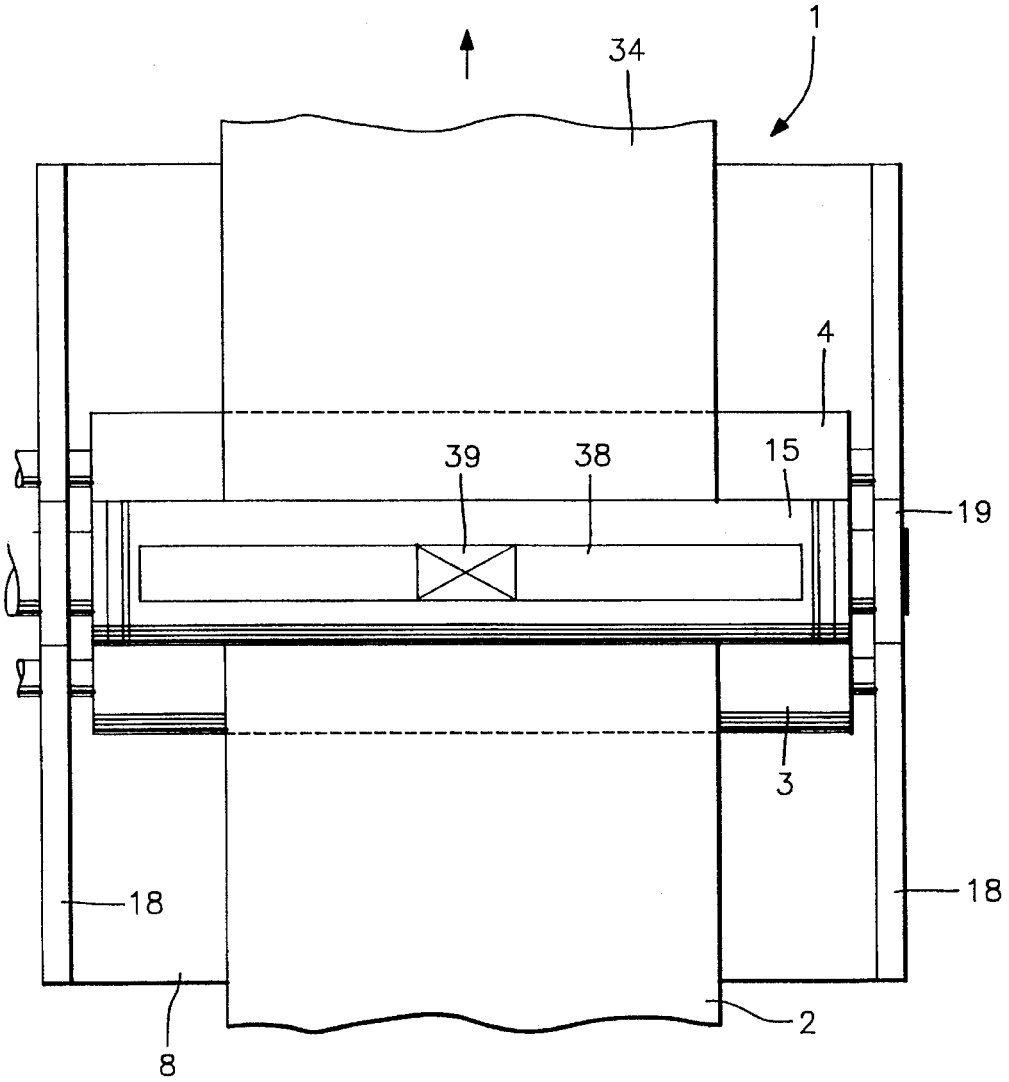

MACHINE FOR CUTTING A PAPER WEB INTO SHEETS WITH SIMULTANEOUS CUTTING OF A TRANSVERSE STRIP

The invention concerns a machine for cutting a paper web or a similar material into sheets with simultaneous cutting of a transverse strip for each sheet, comprising a stationary bottom knife arranged transversely to the paper web and a rotatable knife cylinder arranged over said bottom knife and likewise transversely to the paper web and having at least one set of mutually associated knife cutting edges which, by close passage of the bottom knife during the rotation of the knife cylinder, successively cut a sheet and a strip, respectively, from the paper web while said paper web is advanced continuously between the bottom knife and the knife cylinder.

The electronic data processing technology has its origin in the USA where the inch system is used for measuring lengths. From the outset electronic data processing machinery as well as EDP related external printing machines have therefore been designed for advancing and printing endless lists with modules in inches. In countries using the metric system this has caused problems of e.g. filing, and the inch modules do not fit the new generations of modern laser printers which can only work with formats based on the metric system. In countries using the metric system paper webs divided into inch modules must therefore be cut into sheets to a great extend, which are standardized within the metric system, a narrow strip being cut for each sheet. Paper webs which e.g. have a module of 12 inches are thus cut down to 297 mm, i.e. A4 format, with simultaneous cutting of a strip of about 7.8 mm from each sheet.

The patent publication WO 82/00970 describes an apparatus capable of performing such an operation. This construction has a stationary bottom knife and an overlying knife cylinder having two knives arranged on their respective sides of a relatively wide slot, which is cut along the knife cylinder and extends into a bore which is provided centrally in the cylinder and extends out to one of the ends of the cylinder where it communicates with a source of vacuum. This arrangement serves to remove the strips as soon as they have been cut from the paper web, the strips being immediately sucked up into the central bore of the knife cylinder via the space between the knives and the longitudinal slot, following which the strips continue axially out through the bore to a collection point. Cutting does not take place as a cutting operation proper, but is more in the nature of a linear compression of the paper of a magnitude such that the fibres of the paper are crushed and torn across. This process requires very big forces which the knife cylinder must be capable of absorbing. However, the knife cylinder is greatly weakened by the longitudinal slot and the central bore and therefore tends to bend at the center during cutting, which will thus tend to be deficient so that some of the strips are not cut cleanly, but are still partly connected to the sheets to the detriment of the following operations. The weak and unstable construction moreover entails that the knives are worn relatively quickly, and that their cutting edges are liable to be crushed, because it is difficult to adjust the knife distance with the necessary accuracy.

With a view to overcoming the above-mentioned drawbacks, the object of the invention is to provide a machine of the type mentioned in the opening paragraph, which has a knife cylinder offering greater resistance to bending than known before, and a knife arrangement permitting quick and extremely accurate adjustment of the knife distance so that the machine is capable of cutting strips and sheets from a continuous paper web with clean and perfect cuts, continuously and without heavy wear of the knives.

This is achieved by means of the novel and unique features of the invention, wherein the knife cylinder is substantially solid, and the knife cutting edges of a mutually associated set are present on a cross-sectionally substantially rectangular knife device which, with one of its faces, is fixed against a chord face provided on the knife cylinder.

To be able to cut the relatively thin paper by crushing the fibres in it the cutting edge of the knife cylinder and the cutting edge of the bottom knife must pass each other at such a small distance that they almost meet each other. Even small variations in this extremely small distance can lead to serious operational stoppages. If the distance is reduced, the cutting edges will tend to crush each other, and if the distance is increased, this can entail that the paper web is not cut cleanly. The latter case may involve costly loss of paper, which is destroyed before the error is observed and corrective measures are taken manually, because machinery of this type has a very great production rate. By means of the above-mentioned construction of the invention both the knife cylinder and the knife setup can be made so stiff that practically no bending takes place because of the hugh load which occurs during cutting. Thus, a constant and uniform cutting edge distance in the overall longitudinal extent of the knives can be maintained continuously in operation. This entails that the machine is capable of working with extremely great liability and of making a product of superior quality. Another advantage obtained is that the cutting edge distance can be adjusted easily and rapidly, because there is now no longer any uncertainty with respect to the selection of the correct cutting edge distance, as is the case when using the art known from the above-mentioned patent publication WO 82/00970, in which the selection must necessarily always be based on a compromise between extreme positions unacceptable per se. The ability of the present construction to maintain a constant and uniform cutting edge distance moreover imparts a long life to the tools.

The cut strips are normally to be removed before they, and the cut sheets, arrive at the subsequent production stations where their presence might cause considerable damage. For the cut strips to be removed effectively and safely immediately, a longitudinal groove may be cut between the cutting edges of the knife device in an advantageous embodiment, said groove communicating via a channel system in both the knife device and the knife cylinder with a valve arrangement to connect the groove, during the cutting process, with a source of vacuum during cutting and then with a source of compressed air or the atmosphere. Each of the cut strips will hereby be sucked up into the longitudinal groove between the cutting edges as soon as it has been cut from the paper web. Because of the vacuum the strip remains in the groove until the knife cylinder has rotated through a suitable angular distance from the bottom knife, and then the strip is blown away from the knife cylinder by means of compressed air. A suction funnel may optionally be arranged at the location where the stip is blown off, said funnel communicating via a channel with a source of vacuum and serving to remove the strips completely from the work place. In the latter case, it will usually be sufficient to have the valve arrangement close the vacuum and connect the longitudinal groove between the cutting edges with the atmosphere.

In a particularly advantageous embodiment the knife device may be composed of an inner knife fixed against the chord face of a knife cylinder and an outer knife fixed against the outer side of the inner knife, said outer knife carrying the cutting edge for cutting the sheet, and said inner knife carrying the cutting edge for cutting the strip. It will hereby be easier to sharpen the cutting edges which are now located on their respective knives. The machine can moreover be switched over to cutting the paper strip from one or the other of the two modules rapidly and in a simple manner. When just the inner knife is mounted, the machine will thus cut the paper web into inch formats, and when also the outer knife is mounted, the paper strip will be cut into millimeter formats.

To facilitate the manufacture and sharpening of the inner knife additionally, its cutting edge can advantageously be in the same plane as its outer side.

In a particularly simple embodiment the cutting edge of the outer knife may be formed by the outer side of the knives and the bottom face of the groove. This cutting edge is easy to sharpen, but since the angle is obtuse, a relatively great force is required to cut the paper web. This force is reduced when the cutting edge of the outer knife is formed by the outer side of the knife and a face extending obliquely downwards toward the edge member of the cutting edge from the bottom face of the groove.

Figure 3:
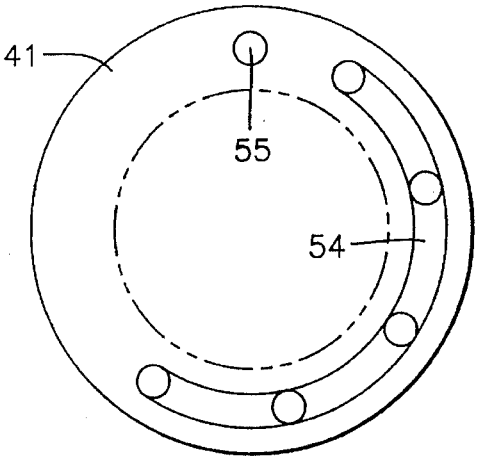
Figure 7:
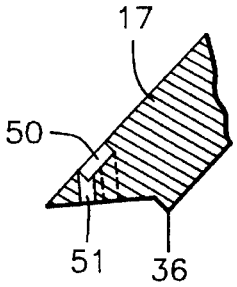
Figure 2:
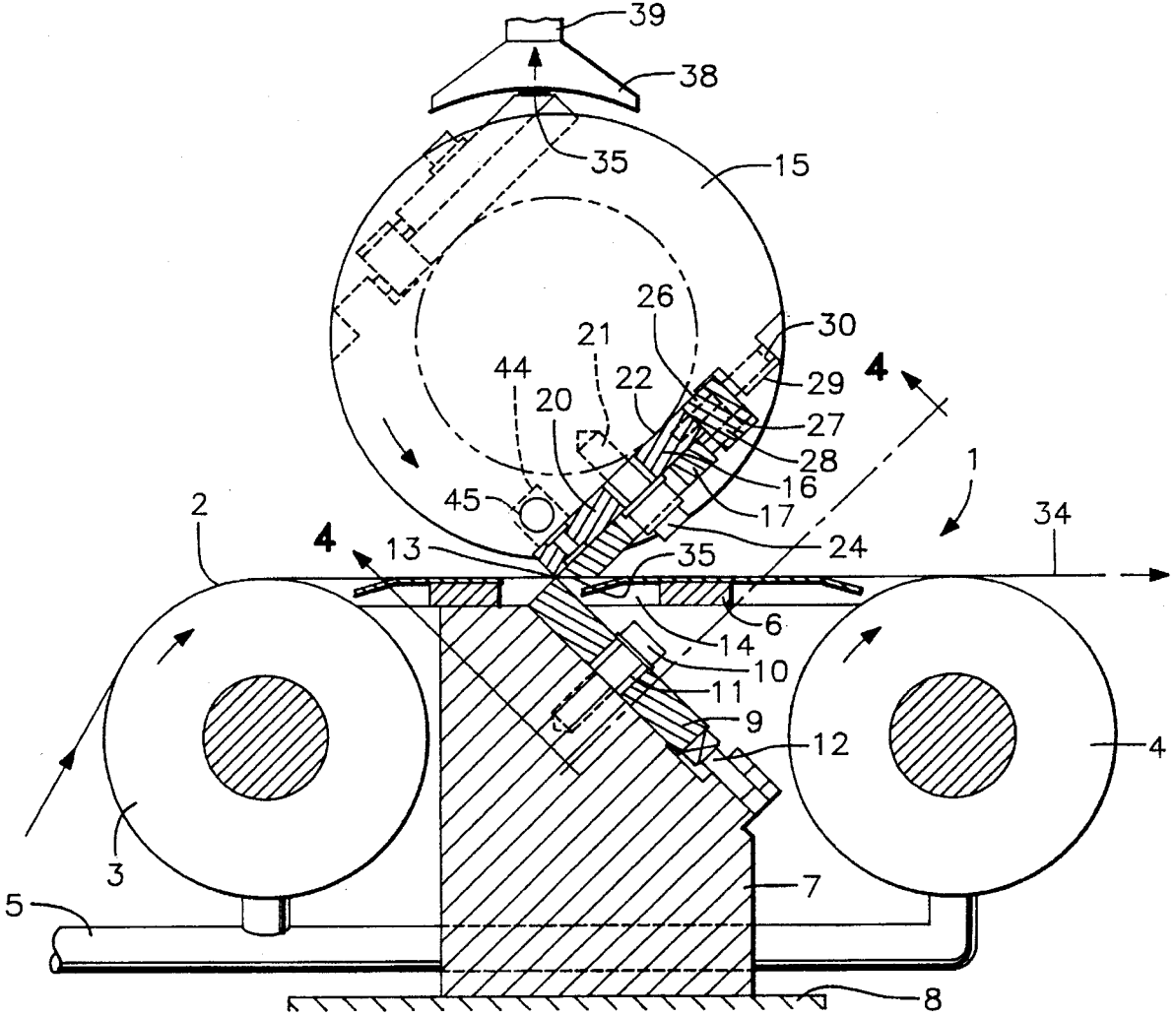
Figure 4:
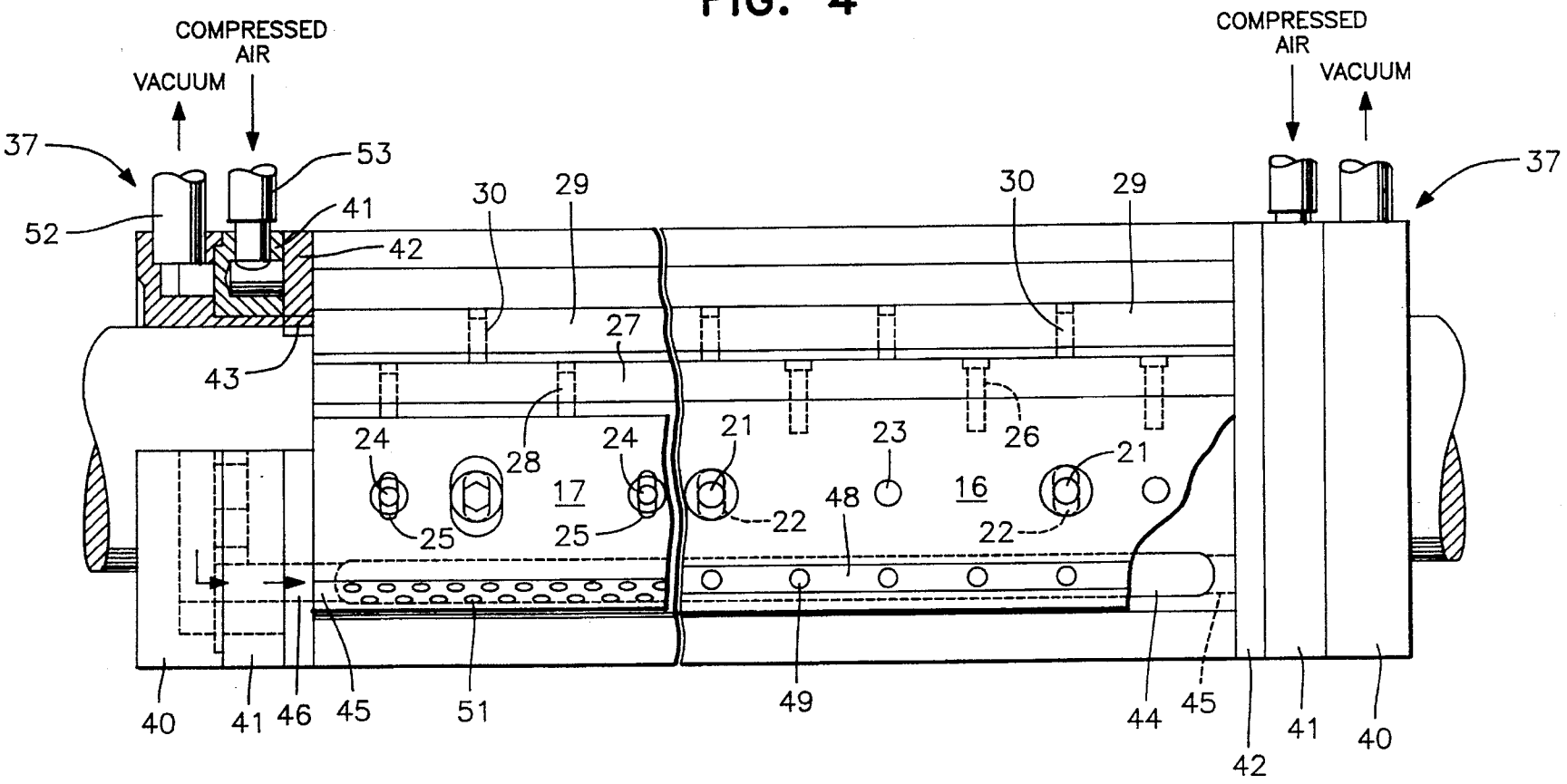
Figure 5:
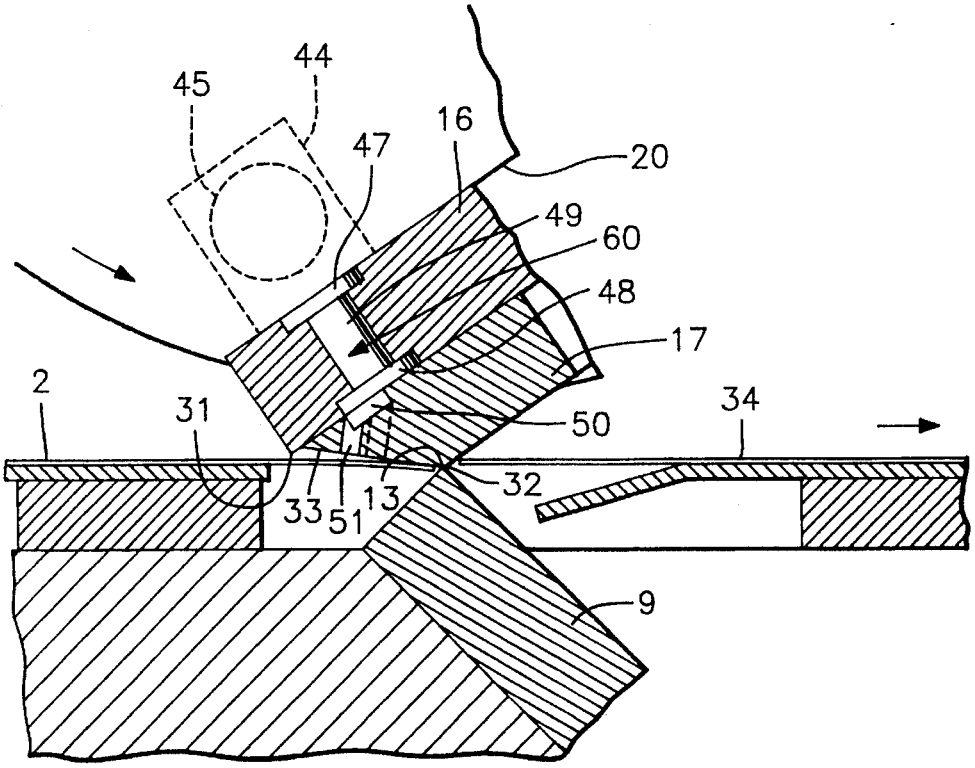
Figure 6:
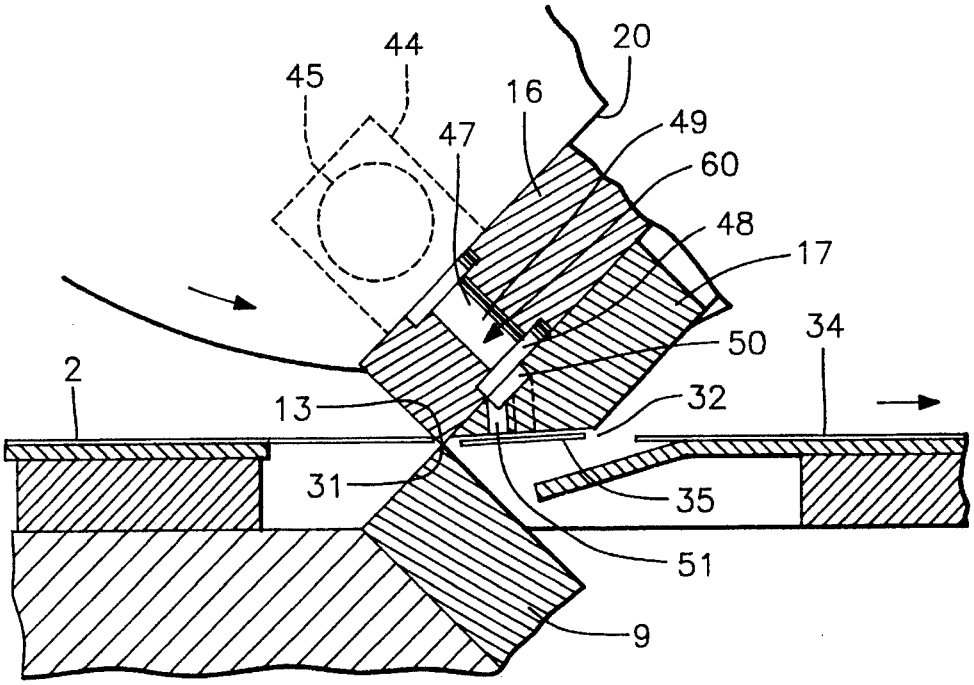

The invention will be explained more fully by the following description of embodiments, which just serve as examples, and further advantageous properties and technical effect will be disclosed, with reference to the drawing, in which FIG. 1 is a schematic top view of a machine according to the invention, FIG. 2 is a partially sectional, lateral view of the same, FIG. 3 is a lateral view of a valve disc for the machine shown in FIGS. 1 and 2, FIG. 4 shows the machine of FIGS. 1 and 2 along the line IV—IV in FIG. 2, and illustrates an inner knife and an outer knife, a portion of one end of each of the knives being removed to show the arrangement of the underlying parts, FIG. 5 is an enlarged, partially sectional, lateral view of a fragment of a knife device associated with the machine of FIGS. 1–4 with the inner knife and the outer knife in a position where the outer knife is cutting a sheet, FIG. 6 shows the same, but in a position where the inner knife is cutting a strip, and FIG. 7 shows a fraction of a second embodiment of an outer knife.

FIGS. 1 and 2 show a machine which is generally designated 1 and which serves to successively cut a continuous paper web into sheets and strips, respectively. When the mutual position of the various components of the machine is mentioned below with respect to a vertical plane and a horizontal plane, this refers to the position which the machine assumes in FIGS. 1 and 2. This, however, just serves as an example, and the machine may have any other spacial orientation within the scope of the invention. The paper web to be cut is designated 2. The paper web, which is wound off a supply roll (not shown), runs over two vacuum rollers 3, 4 in the direction of the arrow. The vacuum rollers, which are connected with a source of vacuum (not shown) in a known manner via a conduit 5, serve to advance the paper web 2 over a table 6. Usually, the right vacuum roller 4 rotates faster than the left vacuum roller 3 to keep the paper web smoothly stretched during cutting and then to remove the cut sheet quickly.

The figures show the simple case where the width of the paper web corresponds to the width of the resulting sheet. However, in practice the paper web is frequently so wide as to accommodate several sheets juxtaposed. The paper web is then first cut longitudinally to the desired format width before arriving at the machine for cutting the web transversely. Since the knife cylinder is now to cut several sheets at once, it must necessarily have a correspondingly great distance between the supports in the bearings, and since bending increases to the fourth power with this distance, the demands on the stiffness of the knife cylinder are intensified to an extremely great degree.

An inclined, stationary bottom knife 9 is fixed to an upstanding knife holder 7, which is mounted on a frame 8 associated with the machine, by means of a plurality of screws 10 which extend through elongate openings 11 permitting the knife to be displaced transversely when it is to be adjusted. This adjustment takes place by means of set screws 12, which also serve to absorb the power component acting in the plane of the bottom knife during cutting. The bottom knife 9 extends via a slot 14 in the table up through said table at a height where the edge 13 of the knife is flush with the top side of the table and thus the underside of the paper web 2.

A solid knife cylinder 15 carrying an inner knife 16 and an outer knife 17 is mounted at a distance above the table 6 and the bottom knife 9. As shown in FIG. 1, the knife cylinder is rotatably mounted in bearings 19 provided on side members 18 associated with the frame 8 of the machine. Also the vacuum rollers 3, 4 are rotatably mounted in bearings (not shown) in these side members 18. The knife cylinder 15 and the side members 3, 4 are all caused to rotate by means of a drive arrangement (not shown) known per se.

A portion of the knife cylinder 15 has been cut away to form a chord face 20. As shown in FIGS. 2 and 4, the inner knife 16 is fixed to this chord face 20 by means of screws 21, which extend through elongate openings 22 permitting the knife to be set and adjusted transversely. The inner knife 16 is provided with threaded holes 23 serving to fix the outer knife 17 on the exterior of the inner knife 16 by means of screws 24 which extend through elongate openings 25 permitting the outer knife to be displaced transversely. A fillet 27 is fixed to the rear edge of the inner knife 16 by means of screws 26. Setting and adjustment of the outer knife 17 takes place by means of set screws 28 in this fillet 27. These set screws 28 moreover serve to absorb the component of the forces acting in the plane of the knife during cutting. The knife cylinder 15 is moreover provided with a projection 29 having set screws 30 for setting and adjusting the inner knife 16. These set screws 30 likewise serve to absorb a component acting in the plane of the knife during cutting.

As shown best in FIGS. 5 and 6, the inner knife 16 has an edge 31 and the outer knife 17 an edge 32. The two edges 31, 32 define a longitudinal groove 33. When the knife cylinder 15 rotates, the two edges 31, 32 one by one pass the edge 13 of the bottom knife 9 at such a small distance that is cannot be indicated in the drawing. In FIG. 5 the edge 32 of the outer knife 17 just meets the edge 13 of the bottom knife 9, thereby crushing the fibres of the paper along a line, and the sheet 34 disposed to the right is torn off the paper web 2. Since the right vacuum roller 4 rotates faster than the left vacuum roller 3, the sheet 34 is then rapidly moved further on to e.g. a stacker.

In FIG. 6 the edge 31 of the inner knife 16 meets the edge 13 of the bottom knive 9, thereby cutting a transverse strip 35 from the paper web 2. If the paper web is divided into inch measures with a module of e.g. 12 inches, and the finished sheets are to be in A4 format with a length of 297 mm, it is necessary for each sheet to cut a strip of about 7.8 mm. When both knives 16, 17 are mounted as shown in FIGS. 5 and 6, the paper web is thus cut into millimeter formats. The machine can directly be switched over to cutting the paper web into inch formats instead merely by dismounting the outer knife 17. This involves the considerable advantage that one and the same machine can be used equally well within both systems of measurement.

As shown, one side of the cutting edge of the inner knife 16 is disposed in the same plane as the outer side of the knife. This imparts a simple structure to the knive, which is easy to sharpen and keep in good order. The outer knife 17 shown in FIGS. 5 and 6 has a cutting edge with an obtuse angle, which is likewise easy to sharpen and keep in good order. On the other hand, greater forces are required to crush the fibres of the paper. These forces are smaller than in the embodiment shown in FIG. 7, in which the outer knife 17 has a cutting edge with an acute angle.

As mentioned before, it is necessary to remove the strips 35 before they arrive at the subsequent production steps and cause damage here. This problem is solved by sucking the cut strips 35 up in to the groove 33, which communicates via a channel system 60 with a valve arrangement, which is connected with a vacuum source (not shown) and a compressed air source (not shown) or the atmosphere. In the situation shown in FIG. 6 the groove 33 is connected with the vacuum source, and the strip 35 is held in the groove 33 by suction. In FIG. 2 the knife cylinder 15 is shown in dotted line in a position in which it has now been rotated through an angle of about 180°. A suction funnel 38 is arranged at this location in the vicinity of the knife cylinder, said suction funnel being connected with a vacuum source (not shown) via a channel 29. The valve arrangement 37 now applies a positive pressure to the groove 33 instead of a negative pressure, whereby the strip 35 is blown up into the funnel 38 and is removed from the work place via the channel 39. If the suction above the funnel 38 is sufficiently strong, it will in most cases merely be necessary to connect the groove 35 with the atmosphere when the strip is to be removed from the knife cylinder.

The valve arrangement 37 is shown more fully in FIGS. 3 and 4. The valve arrangement substantially consists of a metal or plastic ring 40 which carries a valve ring 41, which may expediently be of plastics.

The valve ring 41 rests slidingly rotatably on a ground steel ring 42 which with a spline 43 is splined to the knife cylinder 15, such that it follows the rotation of the knife cylinder. The valve arrangement 37, on the other hand, is stationary. As shown, a valve arrangement 37 is provided at each end of the knife cylinder 15. However, in other cases it will be sufficient merely to have a valve arrangement at one end of the knife cylinder.

As shown best in FIGS. 4, 5 and 6, a channel system 60 connecting the groove 33 with the valve arrangement 37 is provided in the knife cylinder and the knives. This system comprises a longitudinal groove 44 which is cut in the knife cylinder 15 and opens toward the chord face 20. Holes 45, extending from the end faces of the knife cylinder into the groove 44, communicate with the valve arrangement 37 via corresponding holes 46 in the steel rings 42. Similarly, a longitudinal groove 47, 48 is provided in the inner knife 16 in alignment with the groove 44 of the knife cylinder on each side of the inner knife 16. These grooves are in turn interconnected by means of a plurality of transverse holes 49. Further, the inner side of the outer knife 17 is formed with a longitudinal groove 50 aligned with the groove 48 on the outer side of the inner knife 16. This groove 50 is in turn connected with the longitudinal groove 33 between the cutting edges of the knife cylinder by means of a plurality of suction holes 51.

As shown in FIGS. 3 and 4, the valve ring side facing the steel ring 42 is provided with a curved slot 54 connected with the vacuum source (not shown) via a conduit 52. Similarly, another slot 55 is provided, which is merely in the form of a hole in the shown case, and which is connected with the compressed air source (not shown) or the atmosphere via a conduit 53.

In the situation shown in FIG. 2, the hole 45 in the end face of the knife cylinder is aligned with the vacuum slot 54. Vacuum then prevails in the longitudinal groove 33 between the cutting edges of the knife cylinder, so that the cut strip is held in the groove by suction, and this continues until the knife cylinder has rotated so much that the hole 45 has passed the slot 54. This interrupts the vacuum, which is immediately replaced by a positive pressure or the pressure of the atmosphere when the hole 35 rotates into the position in front of the compressed air slot 55. The held strip 35 is now sucked up into the suction funnel 38, as described previously.

The invention is described above and shown on the drawing on the basis of the exemplary assumption that it was paper webs that were to be cut into either inch or millimeter measures. It goes without saying that the machine of the invention can equally well be used for cutting endless webs of another thin material than paper and into sheets and strips of any size, which merely depends upon the dimensions of the knife cylinder and the knives. Furthermore, more than one set of knives may be provided on the knife cylinder.

I claim:

1. A machine for simultaneously cutting a web into sheets and adjacent strips, the web movable in a direction during cutting, said machine comprising:

a substantially stationary knife having a knife edge extending substantially transverse to said direction;

a knife-supporting cylinder mounted for powered rotation about an axis of rotation, and having a peripheral surface which has at least one chord face;

a first knife mounted to said chord face for movement with said cylinder;

a second knife mounted to said chord face for rotation with said cylinder;

said first and second knives having first and second knife edges, respectively, circumferentially spaced from each other in the direction of rotation of said cylinder about said axis, and mounted for cooperation with said stationary knife to effect cutting of the web during rotation of said cylinder;

a web cut strip-retaining groove provided between said first and second knife edges, said groove connected to a channel system formed in one or both of said first and second knives, and a valve arrangement for selectively connecting said channel system to a source of vacuum, or to a source of compressed or ambient air.

2. A machine as recited in claim 1 further comprising:

a suction funnel substantially stationarily mounted remote from said stationary knife and positioned with respect to said cylinder so as to remove strips of the web from the cylinder.

3. A machine as recited in claim 2 wherein said valve arrangement connects said source of vacuum to said channel system when said groove is adjacent said stationary knife, and to said source of compressed or ambient air when said groove is adjacent said suction funnel.

4. A machine as recited in claim 1 wherein said valve arrangement connects said source of vacuum to said channel system when said groove is adjacent said stationary knife, and to said source of compressed or ambient air when said groove is remote from said stationary knife so that a web strip disposed in said groove moves out of said groove.

5. A machine as recited in claim 4 wherein said channel system comprises: a first longitudinal open groove formed in said cylinder chord face; a second open longitudinal groove formed in said first movable knife adjacent said chord face; a third open longitudinal groove formed in said first movable knife adjacent said second movable knife; a first plurality of through-extending openings connecting said second and third longitudinal grooves; a fourth open longitudinal groove formed in said second movable knife adjacent said first movable knife; and a second plurality of through-extending openings connecting said web cut strip-retaining groove to said fourth longitudinal groove.

6. A machine as recited in claim 1 wherein said channel system comprises: a first longitudinal open groove formed in said cylinder chord face; a second open longitudinal groove formed in said first movable knife adjacent said chord face; a third open longitudinal groove formed in said first movable knife adjacent said second movable knife; a first plurality of through-extending openings connecting said second and third longitudinal grooves; a fourth open longitudinal groove formed in said second movable knife adjacent said first movable knife; and a second plurality of through-extending openings connecting said web cut strip-retaining groove to said fourth longitudinal groove.

7. A machine as recited in claim 1 wherein each of said first and second knives comprises a substantially rectangular block of metal.

8. A machine as recited in claim 7 further comprising a first set of a plurality of screws, and cooperating elongated openings in said first knife, for adjustably connecting said first knife to said face, and a second set of a plurality of screws, and cooperating elongated openings in said second knife, for adjustably connecting said second knife directly to said first knife.

9. A machine as recited in claim 8 wherein said at least one chord face comprises first and second chord faces, said first and second knives connected to said first chord face, and third and fourth knives substantially identical to said first and second knives connected to said second chord face.

10. A machine as recited in claim 9 wherein said second chord face is spaced circumferentially around said cylinder approximately one hundred eighty degrees from said first chord face.

11. A machine for simultaneously cutting a web into sheets and adjacent strips, the web movable in a direction during cutting, said machine comprising:

a substantially stationary knife having a knife edge extending substantially transverse to said direction;

a knife-supporting cylinder mounted for powered rotation about an axis of rotation, and having a substantially peripheral surface and at least one face formed in said peripheral surface not intersecting said axis;

first and second knives each mounted to said face for movement with said cylinder, said first and second knives each having a cutting edge substantially transverse to said direction, a groove formed therebetween, and a channel system associated with the groove;

said first and second knives mounted for cooperation with said stationary knife to effect cutting of the web during rotation of said cylinder at a cutting position;

a source of vacuum connectable to said groove and channel system;

a suction funnel substantially stationarily mounted remote from said stationary knife and positioned with respect to said cylinder so as to remove strips of the web from the cylinder; and a valve means for switching connection of said grove and channel system from said source of vacuum to atmospheric or positive pressure when said groove is aligned with said suction funnel;

said channel system comprises at least one hole formed in one or both of said first and second knives, said groove connected to said channel system and by said valve means to said source of vacuum or a source of atmospheric or positive pressure.

12. A machine as recited in claim 11 said first knife is mounted to a chord face and said second knife is connected to said first knife.

13. A machine for simultaneously cutting a web into sheets and adjacent strips, the web movable in a direction during cutting, said machine comprising:

a substantially stationary knife having a blade extending substantially transverse to said direction;

a knife-supporting cylinder mounted for powered rotation about an axis of rotation, and having a peripheral surface which has at least one chord face;

a first movable knife mounted to said face for movement with said cylinder;

a second movable knife mounted to said first movable knife and cylinder, on an opposite portion of said first movable knife from said cylinder face, for rotation with said cylinder and cooperating with said first movable knife;

said first and second movable knives having first and second knife edges, respectively, circumferentially spaced from each other in the direction of rotation of said cylinder about said axis, and mounted for cooperation with said stationary knife to effect cutting of the web during rotation of said cylinder;

a web cut strip-retaining groove provided between said first and second knife edges, said groove connected to a channel system formed in said movable knives and said cylinder; and wherein said channel system comprises: a first longitudinal open groove formed in said cylinder face; a second open longitudinal groove formed in said first movable knife adjacent said cylinder face; a third open longitudinal groove formed in said first movable knife adjacent said second movable knife; a first plurality of through-extending openings connecting said second and third longitudinal grooves; a fourth open longitudinal groove formed in said second movable knife adjacent said first movable knife; and a second plurality of through-extending openings connecting said web cut strip-retaining groove to said fourth longitudinal groove.

* * * * *